United States Patent [19]

Shotey

[11] Patent Number: 5,041,000

[45] Date of Patent: Aug. 20, 1991

[54] SHROUD FOR ELECTRICAL WALL OUTLETS

[76] Inventor: Michael J. Shotey, 7733 E. Cypress, Scottsdale, Ariz. 85257

[21] Appl. No.: 596,778

[22] Filed: Oct. 12, 1990

[51] Int. Cl.[5] ..... H01R 13/44

[52] U.S. Cl. ..... 439/147; 439/367; 439/521

[58] Field of Search ..... 439/135, 141, 144, 147, 439/367, 371, 373, 464, 519, 521, 892

[56] References Cited

U.S. PATENT DOCUMENTS

| | | | |
|---|---|---|---|
| 2,458,153 | 1/1949 | Festge | 439/141 |
| 4,391,481 | 7/1983 | Golden | 439/141 |
| 4,691,974 | 9/1987 | Pinkerton et al. | 439/147 |
| 4,869,683 | 9/1989 | Nelson | 439/367 |
| 4,921,443 | 5/1990 | Sato | 439/521 |
| 4,944,685 | 7/1990 | Schulte | 439/367 |

*Primary Examiner*—Paula A. Bradley
*Attorney, Agent, or Firm*—Cahill, Sutton & Thomas

[57] ABSTRACT

A shroud detachably attached to the face plate of an electrical socket extends posteriorly to enclose an electrical plug plugged into the electrical socket. The posterior end of the shroud is fastened about the electrical conductor extending from the electrical plug to make the interior of the shroud weather tight.

9 Claims, 2 Drawing Sheets

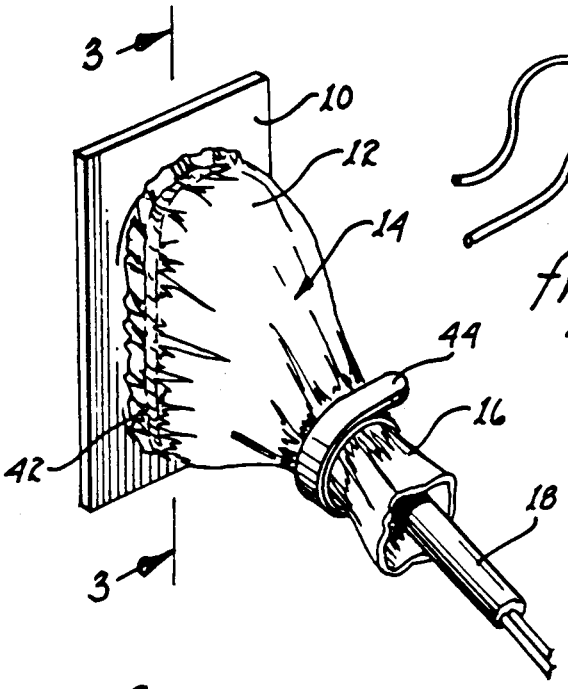
fig. 1
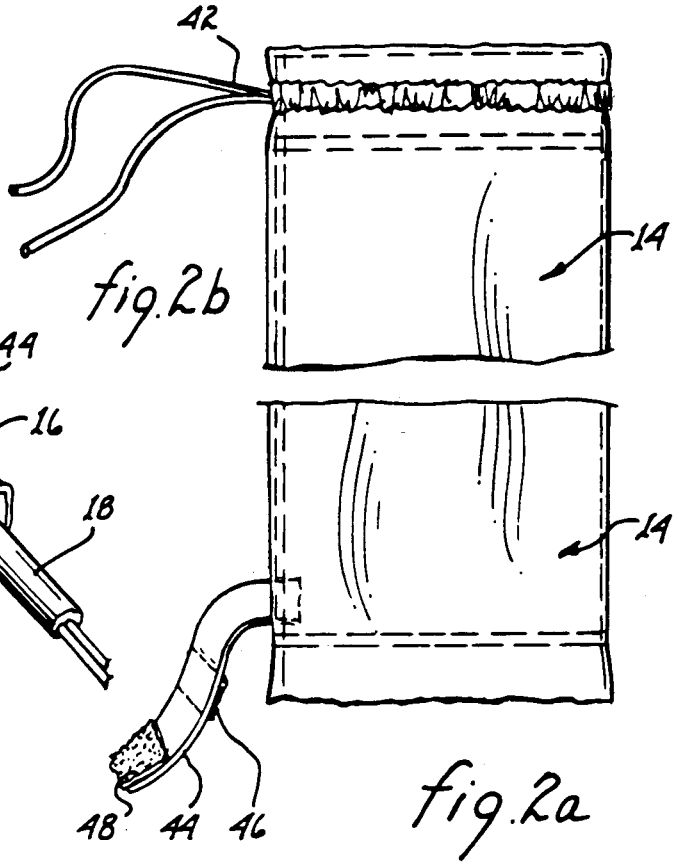
fig. 2b
fig. 2a
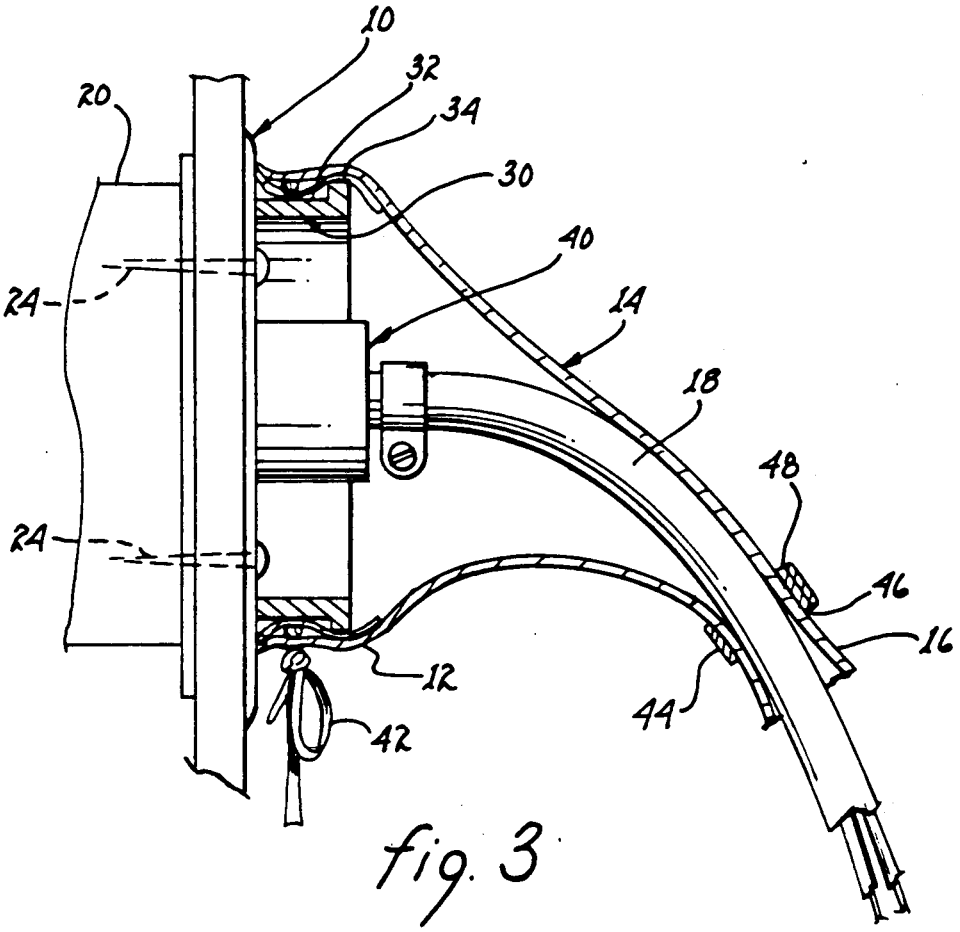
fig. 3

SHROUD FOR ELECTRICAL WALL OUTLETS

BACKGROUND OF THE INVENTION

1. Field of the Invention

The present invention relates to electrical outlet protectors and, more particularly, to a shroud for enclosing and protecting an electrical plug plugged into an electrical outlet.

2. Description of Related Art

Electrical outlets, whether for residential or commercial purposes, are often located outdoors to provide a source of electrical power. The outdoor environment inherently subjects the electrical outlet to moisture through condensation, water from rain or splashing, and to debris. Most outdoor electrical outlets have covers for shielding the outlets during nonuse. Such covers work reasonably well. However, when an electrical plug is plugged into the outlet, the outlet cover is usually ineffective in protecting either the outlet or the plug from water and other substances that may create an electrical hazard. A danger is thus presented to users of electrical outlets.

Various types of covers for shielding electrical plugs plugged into an electrical socket exist. For the most part, such covers are limited to use with a specific size or number of electrical outlets. Moreover, the configuration of the electrical plug which will fit within the confines of the cover is limited. In certain cases, even the diametric dimension of the electrical cord emanating from the electrical plug may be a limiting factor in use of a certain type of cover.

The known covers for shielding plugged in electrical plugs are of rigid construction and usually extend a substantial distance from the associated electrical outlet. The protrusion presented by the cover subjects it to damage from passers by, transport of equipment, etcetera. Since the covers are rigid, breakage is the usual result unless they are extremely robust in which case the electrical outlet may be damaged. Damage to the electrical outlet creates an immediate electrical hazard.

SUMMARY OF THE INVENTION

A flexible sheath includes a first end secured to a socket encircling wall. An electrical plug and accompanying electrical cord is insertable through a second end of the sheath for plugging into the socket. Means are provided to neck down the first end of the sheath in weather tight configuration about the encircling wall and further means are provided at the second end to maintain it weather tight about the cord. In the absence of an electrical plug, the sheath may be housed within the confine defined by the wall.

It is therefore a primary object of the present invention to provide a sheath for protecting an electrical outlet and a mating electrical plug.

Another object of the present invention is to provide a weather tight enclosure for a mating electrical plug and socket.

Still another object of the present invention is to provide a flexible cover for accommodating a plurality of differently sized electrical plugs plugged into an electrical socket.

Yet another object of the present invention is to provide a flexible resilient cover for shielding an electrical socket and mating electrical plug.

A further object of the present invention is to provide a flexible sheath for protecting each of a plurality of electrical plugs one or more of which may be plugged into a corresponding electrical outlet.

A still further object of the present invention is to provide an inexpensive flexible cover for shielding an electrical socket and mating electrical plug.

A yet further object of the present invention is to provide a method for shielding an electrical plug plugged into an electrical socket.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which:

FIG. 1 illustrates a protective sheath in use;

FIGS. 2*a* and 2*b* illustrate variants for attaching each end of the sheath;

FIG. 3 is a cross sectional view taken along lines 3—3, as shown in FIG. 1;

DESCRIPTION OF THE PREFERRED EMBODIMENT

Figure 4:
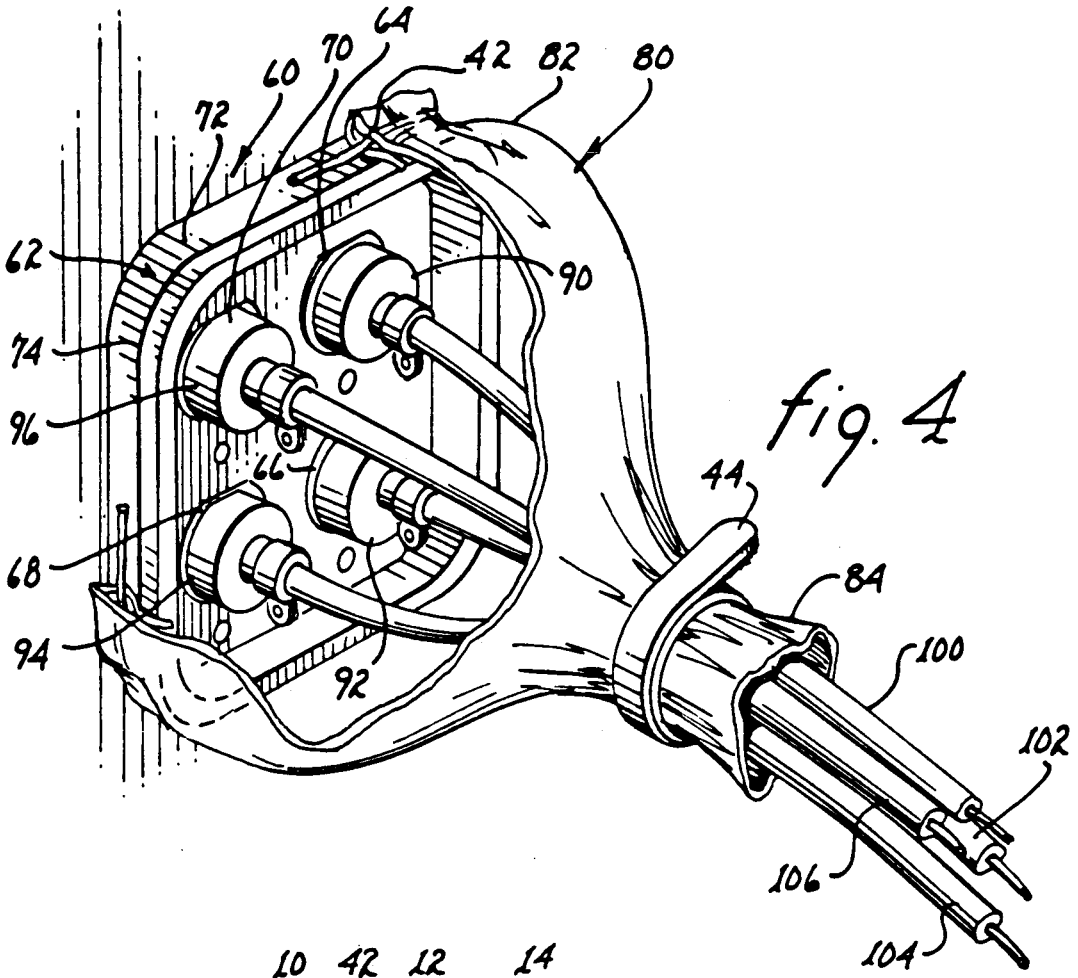
FIG. 4 illustrates mounting and demounting of an electrical plug within the sheath.

Referring to FIG. 1, there is illustrated a face plate 10 encircling a wall mounted electrical outlet. Obviously, such outlet could also be mounted on a stanchion, cabinet, and the like. Anterior end 12 of a shroud 14 is secured to face plate 10 and extends therefrom to enclose and protect against weather the electrical sockets disposed in face plate 10 along with an electrical plug plugged into the socket. Posterior end 16 of the shroud tightly encircles an electrical conductor 18 extending from the electrical plug to seal the posterior end of the shroud.

Shroud 14 is of flexible water tight, if not water impermeable material to prevent incursion of rain water, splashing water and other liquid or solid contaminants into the electrical socket and the electrical plug. Accordingly, shroud 14 provides at least a weather tight enclosure to eliminate an electrical hazard that might otherwise be presented.

Referring jointly to FIGS. 1, 2 and 3, further details attendant face plate 10 and shroud 14 will be described. An electrical outlet box 20 extends through or from a wall member 22 to support an electrical socket or sockets. Face plate 10 is secured to the electrical outlet box by attachment means, such as screws 24. A continuous wall 30 extends from the face plate to define a channel 32 intermediate the face plate and an annular ridge 34. The continuous wall extends about the socket or sockets into which electrical plug 40 may be plugged.

Anterior end 12 of shroud 14 may include a draw string 42 for securing the anterior end within channel 32, as shown in FIG. 2*b*. Alternatively, the anterior end may include a strap 44 having hook and loop fastener means 46, 48, such as that sold under the trademark Velcro and illustrated in FIG. 2*a*. This permits the strap to be wrapped about anterior end 12 and fasten upon itself to secure the anterior end within channel 32. The annular protrusion provided by ridge 34 will preclude disengagement of the anterior end from the continuous wall. Posterior end 16 of shroud 14 may also include a strap 44 having hook and loop fastener means 46, 48 secured thereto, such as that shown in FIG. 2*a*. By wrapping strap 44 about the posterior end encircling electrical conductor 18, a reasonably good weather tight seal about the electrical conductor can be achieved. Alternatively, a draw string arrangement, such as shown in FIG. 2*b*, may be disposed at posterior end 16. It is contemplated that plastic or metallic clip means could also be used for either or both of the anterior and posterior ends of shroud 14.

Figure 5:
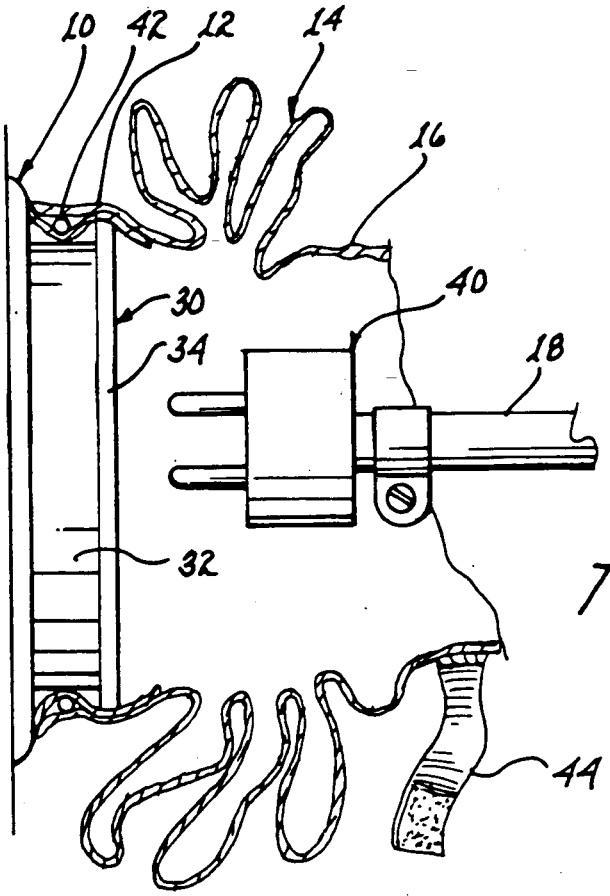
FIG. 5 illustrates a sheath for enclosing a plurality of plugged in electrical plugs.

Referring to FIG. 5 there is illustrated a face plate 60 having a continuous wall 62 extending therefrom in encircling relationship with a plurality of electrical sockets, such as sockets 64, 66, 68 and 70. The continuous wall includes a channel 72 defined by the surface of face plate 60 and an outwardly extending continuous ridge 74. A shroud 80 includes an anterior end 82 for encircling continuous wall 62. A strap, such as strap 44 shown in FIG. 2*a* or a draw string 42, as shown in FIG. 2*b*, may be employed to secure anterior end 82 within channel 72.

One or more electrical plugs 90, 92, 94 and 96, may be plugged into corresponding ones of electrical sockets 64, 66, 68 and 70. Electrical conductors 100, 102, 104 and 106 extend from the respective electrical plugs. Posterior end 84 of shroud 80 encircles the electrical conductors. The shroud is maintained in weather tight relationship about the conductors by a strap 44, which may have fastening means such as that illustrated and described with respect to FIG. 2*a*. Alternatively, a draw string 42 may be employed, as illustrated in FIG. 2*b*. Under certain circumstances, it may be preferable to use plastic or metallic clips to secure each of the anterior and posterior ends of shroud 80.

The mode of use of shroud 14 or shroud 80 will be described with reference to FIG. 4. For sake of simplicity, the reference numerals used in conjunction with FIGS. 1 and 3 will be repeated. After anterior end 12 of shroud 14 has been secured within channel 32 of continuous wall 30 by a strap or draw string, plug 40 is inserted through open posterior end 16 for engagement with the electrical socket. After the electrical plug has been plugged in, posterior end 16 is wrapped about electrical conductor 18 and retained in place by the fastening means discussed above. Upon attachment of the shroud, the electrical socket and the junction between the electrical socket and the electrical plug becomes shielded against the weather and other liquid or solid contaminants that may be or may become present. Accordingly, the likelihood of an injurious or damaging electrical shock through inadvertent contact with the electrically charged socket or plug is precluded. It may be noted that since shroud 14 and shroud 80, are flexible, inadvertent contact with the shroud by a person or objects will generally result in accommodating flexing or movement of the shroud rather than cracking or damage as may occur with a rigid protective device.

To unplug plug 40, posterior end 16 of shroud 14 is opened by disengaging the fastening means. The shroud can then be pushed toward face plate 10, as illustrated in FIG. 4, to provide access to plug 40 through the opening in the posterior end. Alternatively, an operator can reach into the shroud through the posterior end to grasp and withdraw the plug. To remove and/or replace shroud 14, the fastening means for anterior end 12 is unfastened and the shroud can be withdrawn from about continuous wall 30.

During nonuse of the electrical sockets, the shroud, if retained upon the continuous wall, can be stuffed within the confine defined by the continuous wall. Such stuffing will tend to protect the shroud against damage and also serve a secondary function of shielding the electrical sockets from inadvertent contact or exposure to the elements.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A shroud for protecting an electrical socket and for protecting an electrical plug plugged into the electrical socket against incursion of foreign matter, said shroud comprising in combination:

(a) a sheath of flexible water resistant material for discouraging incursion of water within said sheath, said sheath being of sufficient cross sectional size to accommodate insertion of the electrical plug thereinto for engagement with the electrical socket;

(b) a face plate surrounding the electrical socket;

(c) means for securing one end of said sheath to said face plate in encircling relationship with the electrical socket; and (d) means for closing the other end of said sheath to form a barrier against incursion of foreign matter into the electrical socket, said closing means including means for attaching the other end of said sheath about the electrical conductor extending from the electrical plug, said attaching means including a strap for wrapping about the other end of said sheath and means for securing said strap to itself to maintain the other end closed.

2. A shroud for protecting an electrical socket and for protecting an electrical plug plugged into the electrical socket against incursion of foreign matter, said shroud comprising in combination:

(a) a sheath of flexible water resistant material for discouraging incursion of water within said sheath;

(b) a face plate surrounding the electrical socket;

(c) a continuous wall extending from said face plate in encircling relationship with the electrical socket, said wall including an outwardly facing channel;

(d) means for securing one end of said sheath about said wall and within said channel in encircling relationship with the electrical socket, said securing means including further means for securing said strap to itself to maintain the one end of said sheath fastened to said channel; and (e) means for closing the other end of said sheath to form a barrier against incursion of foreign matter into the electrical socket.

3. A shroud for protecting an electrical socket and for protecting an electrical plug plugged into the electrical socket against incursion of foreign matter, said shroud comprising in combination:

(a) a sheath of flexible water resistant material for discouraging incursion of water within said sheath, said sheath being of sufficient cross sectional size to accommodate insertion of the electrical plug thereinto for engagement with the electrical socket;

(b) a face plate surrounding the electrical socket;

(c) a continuous wall extending from said face plate in encircling relationship with the electrical socket;

(d) means for securing one end of said sheath to said face plate in encircling relationship with the electrical socket; and (e) means for closing the other end of said sheath to form a barrier against incursion of foreign matter into the electrical socket, said closing means including means for attaching the other end of said sheath about the electrical conductor extending from the electrical plug and a strap for wrapping about the other end of said sheath and further means for securing said strap to itself to maintain the other end closed.

4. A method for protecting an electrical socket and for protecting an electrical plug plugged into the electrical socket against incursion of foreign matter, said method comprising the steps of:

(a) securing one end of a sheath of flexible water resistant material to a face plate surrounding the electrical outlet;

(b) inserting the electrical plug into the sheath to engage the electrical socket prior to exercise of said step of closing; and (c) closing the other end of the sheath to form a barrier against incursion of foreign matter into the electrical outlet, said step of closing including the steps of securing the other end of the sheath about the electrical conductor extending from the electrical plug, wrapping a strap about the other end of the sheath and fastening the wrapped strap to itself.

5. A method for protecting an electrical socket and for protecting an electrical plug plugged into the electrical socket against incursion of foreign matter, said method comprising the steps of:

(a) securing one end of a sheath of flexible water resistant material to a face plate surrounding the electrical outlet including the steps of attaching the one end of the sheath to a continuous wall encircling the electrical socket, fastening the one end of the sheath in a channel disposed on the surface of the continuous wall, wrapping a strap about the one end of the sheath and fastening the wrapped strap to itself and (b) closing the other end of the sheath to form a barrier against incursion of foreign matter into the electrical outlet.

6. A method for protecting an electrical socket and for protecting an electrical plug plugged into the electrical socket against incursion of foreign matter, said method comprising the steps of:

(a) securing one end of a sheath of flexible water resistant material to a continuous wall extending from a face plate surrounding the electrical outlet;

(b) inserting the electrical plug into the sheath to engage the electrical socket; and (c) closing the other end of the sheath to form a barrier against incursion of foreign matter into the electrical outlet, said step of closing including the steps of securing the other end of the sheath about the electrical conductor extending from the electrical plug, wrapping a strap about the other end of the sheath and fastening the wrapped strap to itself.

7. A shroud for protecting an electrical socket and for protecting an electrical plug plugged into the electrical socket against incursion of foreign matter, said shroud comprising in combination:

(a) a sheath of flexible water resistant material for discouraging incursion of water within said sheath;

(b) a face plate surrounding the electrical socket;

(c) means for securing one end of said sheath to said face plate in encircling relationship with the electrical socket; and (d) means for closing the other end of said sheath to form a barrier against incursion of foreign matter into the electrical socket, said closing means including a strap for wrapping about the other end of said sheath.

8. A shroud for protecting an electrical socket and for protecting an electrical plug plugged into the electrical socket against incursion of foreign matter, said shroud comprising in combination:

(a) a sheath of flexible water resistant material for discouraging incursion of water within said sheath;

(b) a face plate having wall means surrounding the electrical socket;

(c) means for securing one end of said sheath to said wall means in encircling relationship with the electrical socket, said securing means including means for wrapping about the one end of said sheath to maintain said one end fastened to said wall means; and (d) means for closing the other end of said sheath to form a barrier against incursion of foreign matter into the electrical socket.

9. The shroud as set forth in claim 8 wherein said closing means includes a strap for wrapping about the other end of said sheath.

* * * * *